US010287713B2

(12) United States Patent
Yamauchi et al.

(10) Patent No.: US 10,287,713 B2
(45) Date of Patent: May 14, 2019

(54) WARP SHEDDING APPARATUS OF LOOM

(71) Applicant: KABUSHIKI KAISHA TOYOTA JIDOSHOKKI, Kariya-shi, Aichi-ken (JP)

(72) Inventors: Yasushi Yamauchi, Aichi-ken (JP); Kenji Sumiya, Aichi-ken (JP)

(73) Assignee: KABUSHIKI KAISHA TOYOTA JIDOSHOKKI, Kariya-shi, Aichi-ken (JP)

( * ) Notice: Subject to any disclaimer, the term of this patent is extended or adjusted under 35 U.S.C. 154(b) by 63 days.

(21) Appl. No.: 15/441,740

(22) Filed: Feb. 24, 2017

(65) Prior Publication Data

US 2017/0247819 A1 Aug. 31, 2017

(30) Foreign Application Priority Data

Feb. 25, 2016 (JP) ..... 2016-033968

(51) Int. Cl.

| | |
|---|---|
| ***D03D 49/12*** | (2006.01) |
| ***D03C 3/20*** | (2006.01) |
| ***D03C 9/00*** | (2006.01) |
| ***D03C 11/00*** | (2006.01) |
| *D03D 49/00* | (2006.01) |

(52) U.S. Cl.
CPC ..... *D03C 3/20* (2013.01); *D03C 9/00* (2013.01); *D03C 11/00* (2013.01)

(58) Field of Classification Search
CPC ..... D03D 49/12; D03D 5/00; D03D 47/308; D03D 13/008; D03D 47/40; D03D 49/04; D03C 9/02; D03C 7/00; D03C 9/06
See application file for complete search history.

(56) References Cited

U.S. PATENT DOCUMENTS 3,851,675 A * 12/1974 Schwarz ..... D03C 1/26 139/71
3,860,044 A * 1/1975 Mizuno ..... D03D 49/06 139/109
3,860,045 A * 1/1975 Worcester, Jr. ..... D03D 5/00 139/291 R (Continued)

FOREIGN PATENT DOCUMENTS

EP 0458754 B1 11/1991
EP 1477598 B1 4/2008

(Continued)

OTHER PUBLICATIONS

Communication dated Oct. 13, 2017 from the Philippines Patent Office in counterpart Philippines application No. 1/2017/000043.

*Primary Examiner* — Robert H Muromoto, Jr.
(74) *Attorney, Agent, or Firm* — Sughrue Mion, PLLC

(57) ABSTRACT

A warp shedding apparatus of a loom includes a plurality healds arranged in a weaving width direction of the loom. Each heald has a thread eyelet through which a ground warp yarn is passed and held. The healds are raised and lowered to form a shed. A difference in tension between raised ground warp yarns and lowered ground warp yarns held by the healds located in opposite end portions in the weaving width direction is greater than a difference in tension between raised ground warp yarns and lowered ground warp yarns held by the healds located in a central portion in the weaving width direction.

5 Claims, 6 Drawing Sheets

(56) References Cited

U.S. PATENT DOCUMENTS 3,948,296 A * 4/1976 Koch ..... D03C 9/0625 139/91
4,016,911 A * 4/1977 Looker ..... D03D 3/00 139/383 R
4,063,574 A * 12/1977 Miller ..... D03D 29/00 139/29
4,140,156 A * 2/1979 Trost ..... D03D 41/00 139/194
4,183,381 A * 1/1980 Gotoh ..... D03D 51/34 139/370.1
4,224,967 A * 9/1980 Tagawa ..... D03D 49/12 139/108
4,313,473 A * 2/1982 Reiter ..... D03D 1/0005 139/116.1
4,314,588 A 2/1982 Speich
4,387,743 A * 6/1983 Suzuki ..... D03D 49/12 139/110
4,402,348 A * 9/1983 Kimbara ..... D03D 49/12 139/110
4,473,096 A * 9/1984 Brouwer ..... D03D 47/302 139/188 R
4,593,723 A * 6/1986 Griffith ..... D03C 3/20 139/455
4,949,759 A * 8/1990 Takegawa ..... D03D 39/223 139/102
5,170,821 A * 12/1992 Yoshida ..... D03D 49/04 139/110
6,135,163 A 10/2000 Wahhoud et al.
7,984,732 B2 * 7/2011 Sugiyama ..... D03C 9/06 139/35
8,352,063 B2 * 1/2013 Sugiyama ..... D03C 9/02 700/140
2001/0013377 A1 * 8/2001 Wahhoud ..... D03C 7/00 139/54
2002/0059962 A1 * 5/2002 Nakada ..... D03D 49/20 139/311
2004/0154680 A1 * 8/2004 Schwemmlein ..... B65H 59/04 139/103
2015/0107715 A1 * 4/2015 Potluri ..... D03C 9/02 139/11
2015/0246655 A1 * 9/2015 Furuniwa ..... D03D 1/02 139/420 R
2017/0247819 A1 * 8/2017 Yamauchi ..... D03C 3/20

FOREIGN PATENT DOCUMENTS

JP 09-268450 A 10/1997
JP 09-302550 A 11/1997
JP 2004-232168 A 8/2004

* cited by examiner

WEAVE STRUCTURE IN THE CENTRAL PORTION IN THE WEAVING WIDTH DIRECTION

WEAVE STRUCTURE IN THE OPPOSITE END PORTIONS IN THE WEAVING WIDTH DIRECTION

WARP SHEDDING APPARATUS OF LOOM

BACKGROUND OF THE INVENTION

The present invention relates to a warp shedding apparatus of a loom.

Fabrics that are used for an airbag, a parachute, and the like are woven tightly to have a high density for the specific purposes. In weaving a fabric of high density, a high tension is applied to weft yarns. In such high density fabric, weft yarns tend to be slackened and broken selvages may result at the opposite ends of the fabric in the weaving width direction.

Japanese Unexamined Patent Application Publication No. 9-302550 discloses an improved base fabric for an airbag which does not have loose weft yarns and/or broken selvages. According to the Publication, the base fabric for an airbag is made of synthetic fiber and has a selvage formed of ground yarns and leno yarns, and a plurality of processed reinforcing yarns are added to the selvage.

Generally, the end portion of a selvage in a high density fabric for an airbag may become wavy. Such wavy selvage is specific to high density fabrics and results from the local differences in the tension applied to the weft yarns, or the tension applied to the weft yarns being greater in the central portion of a woven fabric than in the portions thereof adjacent to the selvage edges on the lateral sides of the fabric. When beaten by the reed, the weft yarn becomes slack and wavy in the portions thereof adjacent to the selvage edges and the stress due to the beating is concentrated in such portions adjacent to the selvage edges, which causes irregularities in the weave structure of the above portions of the fabric adjacent to the selvage edges, resulting in defective wavy selvages. In the base fabric for an airbag disclosed in the Japanese Unexamined Patent Application Publication No. 9-302550, the force to grip the selvage edges is increased by additionally weaving reinforcing yarns to thereby prevent defective wavy selvages.

Japanese Unexamined Patent Application Publication No. 2004-232168 discloses a water jet loom having healds that are disposed outward of edges of a woven fabric in the width direction thereof and used for gripping ends of weft yarn, such as ends of selvedge yarns to be trimmed. The shed of the gripping yarns is formed by the healds mounted to either the heald frames for ground yarns or the heald frames for leno yarns. Therefore, in a loom rotating at a speed of 800 rpm or higher, a weft yarn flying in a shed tends to be directed upward under the influence of air pressure generated by beating of the reed. A weft thus diverted upward and moving away from the gripping yarns fails to be gripped, thus causing the loom to stop.

According to the Publication No. 2004-232168, the healds for holding the gripping yarns each have a thread eyelet at a position that is 5 to 15 mm higher than that of the healds for holding warp yarns. With such disposition of the thread eyelet, the raised shed opening amount of the gripping yarns is increased and a weft yarn that may fly upward is prevented successfully from being diverted away from the gripping yarns.

According to the base fabric for an airbag disclosed in the Japanese Unexamined Patent Application Publication No. 9-302550 in which a plurality of reinforcing yarns need be woven at the selvage edges of a fabric in order to prevent slackening of weft yarn and formation of wavy selvages in a high density fabric for an air bag, additional devices for supplying the reinforcing yarns are required. Such devices for supplying reinforcing yarns need have a plurality of bobbins for supplying reinforcing yarns provided in the lateral end portions of a woven fabric, which makes the configuration of the loom complicated. Furthermore, the use of bobbins for supplying the reinforcing yarns that need be replaced periodically increases the man-hour for such maintenance works.

Furthermore, according to the water jet loom disclosed in the Japanese Unexamined Patent Application Publication No. 2004-232168 in which the position of the thread eyelet for the gripping yarns that do not form a part of a woven fabric is set so that weft yarns are caught by the gripping yarns without fail. The water jet loom of the Publication No. 2004-232168 does not have any function to prevent slackening of weft yarns in the selvages or the formation of defective selvages in a fabric for airbag and the like. In particular, the gripping yarns are not required on a side of a woven fabric that corresponds to the weft insertion side of the loom. Therefore, the water jet loom disclosed in the Japanese Unexamined Patent Application Publication No. 2004-232168 is unable to prevent the slackening of weft yarns or the formation of defective selvage in a woven fabric on the side thereof that corresponds to the weft insertion side of the loom.

The present invention, which has been made in view of the above circumstances, is directed to providing a warp shedding apparatus of a loom that prevents slackening of weft yarns and formation of defective selvages in the opposite end portions of a woven fabric in the weaving width direction thereof with simple structure.

SUMMARY OF THE INVENTION

In accordance with an aspect of the present invention, there is provided a warp shedding apparatus of a loom that includes a plurality healds arranged in a weaving width direction of the loom. Each heald has a thread eyelet through which a ground warp yarn is passed and held. In the warp shedding apparatus, the healds are raised and lowered to form a shed. A difference in tension between raised ground warp yarns and lowered ground warp yarns held by the healds that are located in opposite end portions in the weaving width direction is greater than a difference in tension between raised ground warp yarns and lowered ground warp yarns held by the healds that are located in a central portion in the weaving width direction.

Other aspects and advantages of the invention will become apparent from the following description, taken in conjunction with the accompanying drawings, illustrating by way of example the principles of the invention.

DETAILED DESCRIPTION OF THE EMBODIMENTS

First Embodiment

Figure 1:
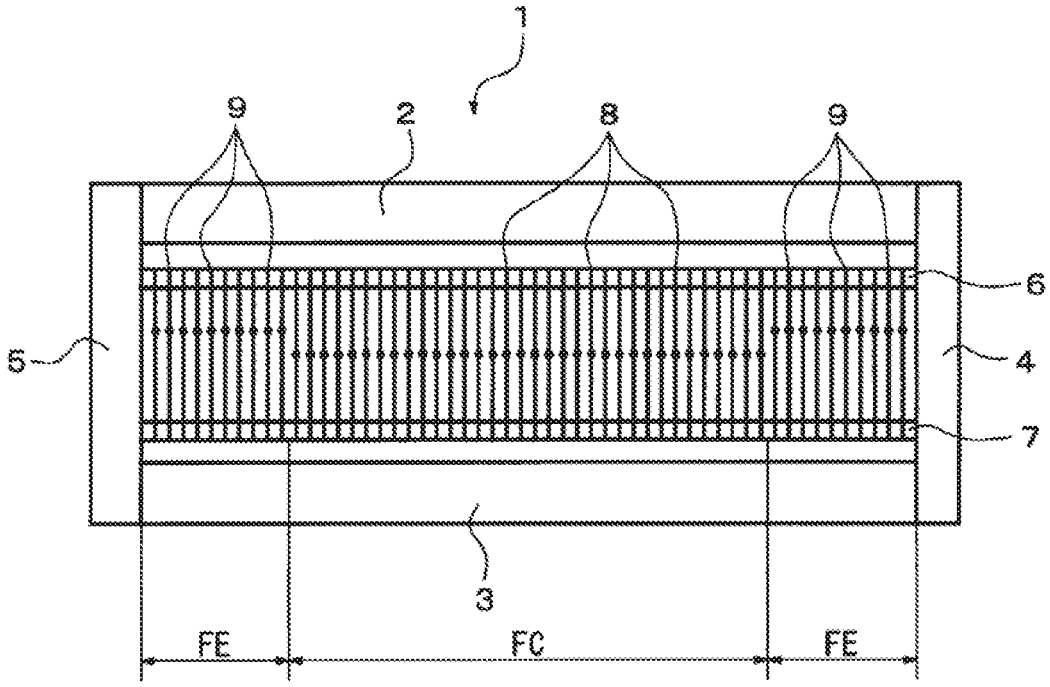
FIG. 1 is a front view of a heald frame of a warp shedding apparatus of a loom according to a first embodiment of the present invention.

A first embodiment of the present invention will now be described with reference to FIGS. 1 to 5. Referring to FIG. 1 showing a rectangular heald frame 1 used in a warp shedding apparatus of a loom according to the first embodiment of the present invention, the heald frame 1 includes an upper frame member 2, a lower frame member 3, and side frame members 4 and 5. An upper carrier rod 6 and a lower carrier rod 7 are provided between the upper frame member 2 and the lower frame member 3 and fixed at the opposite ends thereof to the side frame members 4 and 5. The upper carrier rod 6 is located adjacently to the upper frame member 2 and the lower carrier rod 7 is located adjacently to the lower frame member 3.

Figure 2:
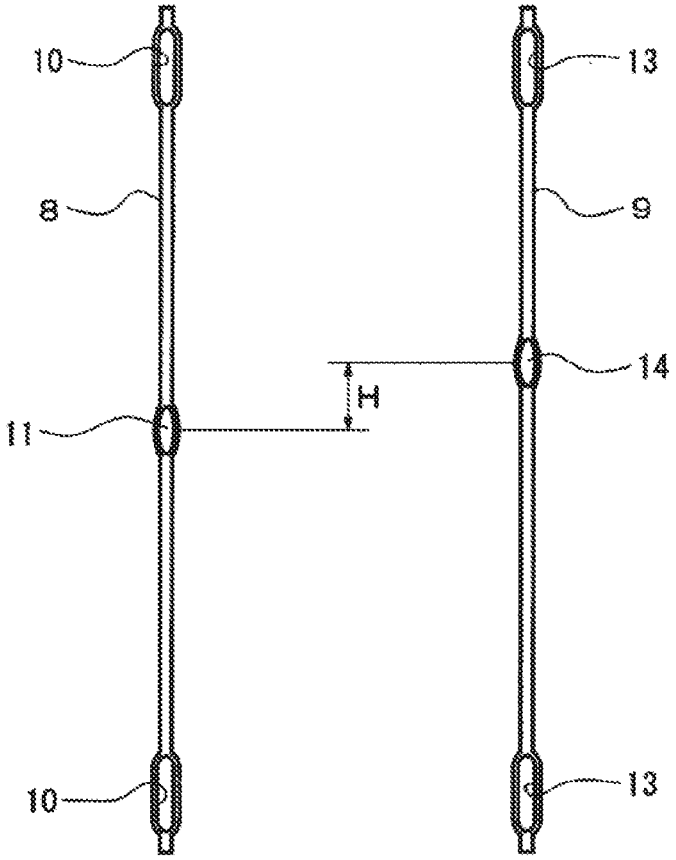
FIG. 2 is an enlarged view showing one of two different types of healds of the heald frame of FIG. 1.

A plurality of healds 8 and a plurality of healds 9 are fixed at the opposite ends thereof to the upper and lower carrier rods 6 and 7. The healds 8 are arranged in a segment FC in the central portion of the heald frame 1 in the weaving width direction of the loom and the healds 9 are arranged in segments FEs located on the opposite sides of the segment FC and adjacent to the opposite ends of the heald frame 1 in the weaving width direction of the loom. The segments FC and FEs correspond to the central portion and the opposite end portions, respectively, of the heald frame of the present invention. As shown in FIG. 2, each heald 8 has two support portions 10 and a thread eyelet 11. The support portions 10 are formed by elongated holes at the upper and lower ends of the heald 8 and attached to the upper carrier rod 6 and the lower carrier rod 7, respectively. The thread eyelet 11 is located at the center of the heald 8 and holds ground warp yarns 12A and 12B (see FIG. 3) that are passed through the thread eyelet 11 and held, and raised and lowered to form a shed in the segment FC. The ground warp yarns 12A and 12B are raised and lowered alternately by the healds 8 mounted to heald frames 1A and 1B (see FIG. 3) to form a shed.

As shown in FIG. 2, each heald 9 has two support portions 13 and a thread eyelet 14. The support portions 13 are formed by elongated holes located at the upper and lower ends of the heald 9 and attached to the upper carrier rod 6 and the lower carrier rod 7, respectively. The thread eyelet 14 is located at a position thereof that is higher than the center of the heald 9, as indicated by distance H in FIG. 2 and holds ground warp yarns 15A and 15B (see FIG. 3) that are passed through the thread eyelet 14 and held, and raised and lowered to form a shed in the segments FEs. The ground warp yarns 15A and 15B are raised and lowered alternately by the healds 9 mounted to the heald frames 1A and 1B to form a shed. As shown in FIG. 2, the thread eyelet 11 of the heald 8 and the thread eyelet 14 of the heald 9 are located so that there is the distance H between the thread eyelet 11 and the thread eyelet 14 in the vertical direction.

Figure 3:
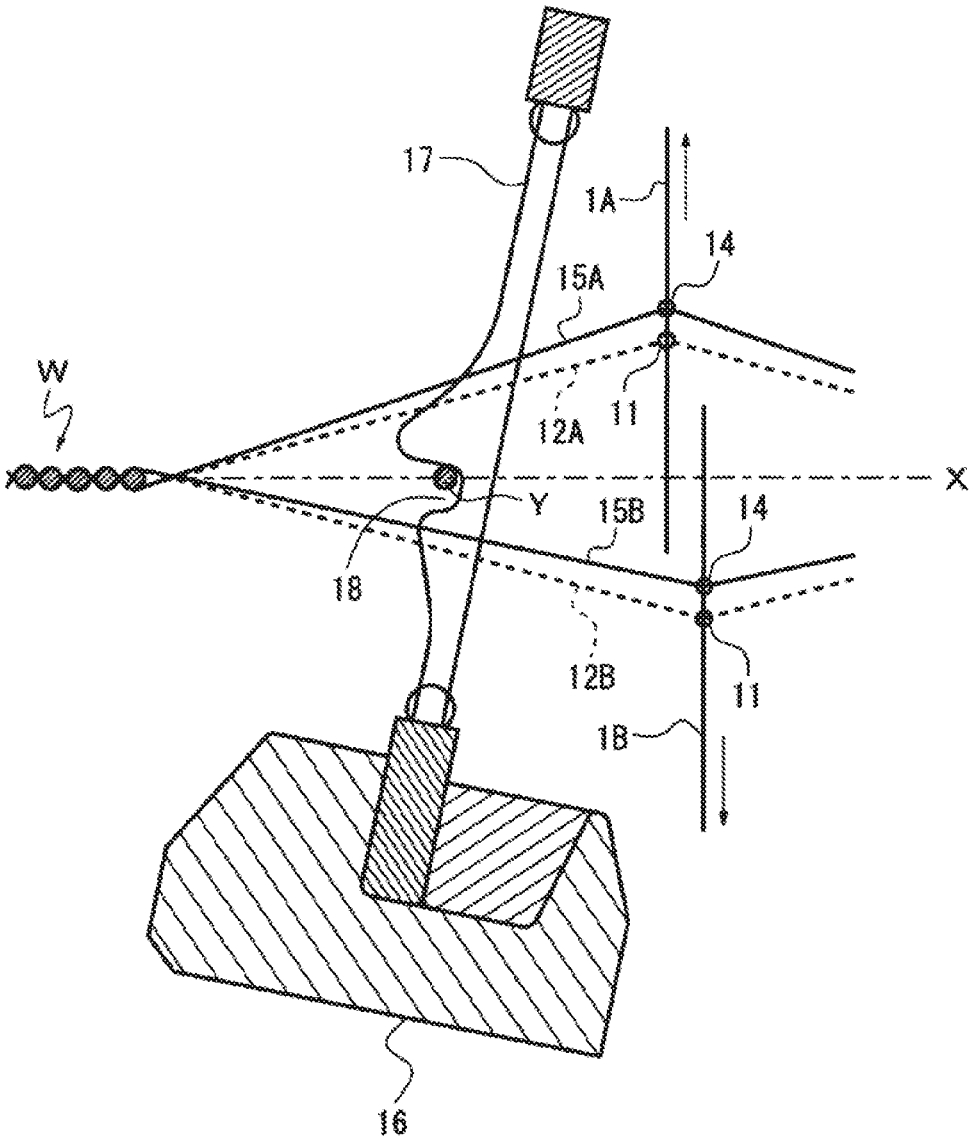
FIG. 3 is a partially sectional enlarged view showing a shed at a time of a weft insertion.

Referring to FIG. 3, in the case of the ground warp yarns 12A and 12B that are passed through the thread eyelets 11 of the healds 8, the shed opening amount of the ground warp yarn 12A at the raised position and the ground warp yarn 12B at the lowered position are substantially the same because the thread eyelets 11 are located at the center of the healds 8. As shown in FIG. 3, in the case of the ground warp yarns 15A and 15B that are passed through the thread eyelets 14, there occurs a difference in the shed opening amount between the ground warp yarn 15A at the raised position and the ground warp yarn 15B at the lowered position because the thread eyelets 14 are located higher than the center of the heald 9.

Therefore, when a shed is formed, there is no difference in tension between the raised ground warp yarn 12A and the lowered ground warp yarn 12B, while there occurs a difference in tension between the ground warp yarn 15A at the raised position and the ground warp yarn 15B at the lowered position. Specifically, according to the present embodiment in which the thread eyelets 11 and 14 are formed at different positions in the respective healds 8 and 9, the differences in the shed opening amount and in the tension between the raised ground warp yarns 15A and the lowered ground warp yarns 15B are greater than those between the raised ground warp yarn 12A and the lowered ground warp yarn 12B. Furthermore, the shed opening amount of the ground warp yarns 15A and 15B in the segments FEs is greater than that of the ground warp yarns 12A and 12B in the segment FC in the central portion.

The heald frames 1A and 1B shown in FIG. 3 may be driven by, for example, a warp shedding apparatus that includes motors connected to their corresponding heald frames to cause the shedding motion, a warp shedding apparatus that is connected to a cam or a crank to cause the shedding motion, or a dobby warp shedding apparatus. In the illustrated embodiment, selvedge yarns for leno selvages (not shown) are arranged at positions of the loom adjacent to the opposite ends of the woven fabric and outward of the segments FE in the weaving width direction. The selvedge yarns are used for forming selvedges of a woven fabric W (see FIG. 3) and caused to form a shed in synchronism with the shedding motion of the ground warp yarns 12A, 15A, 12B, and 15B.

Figure 4:
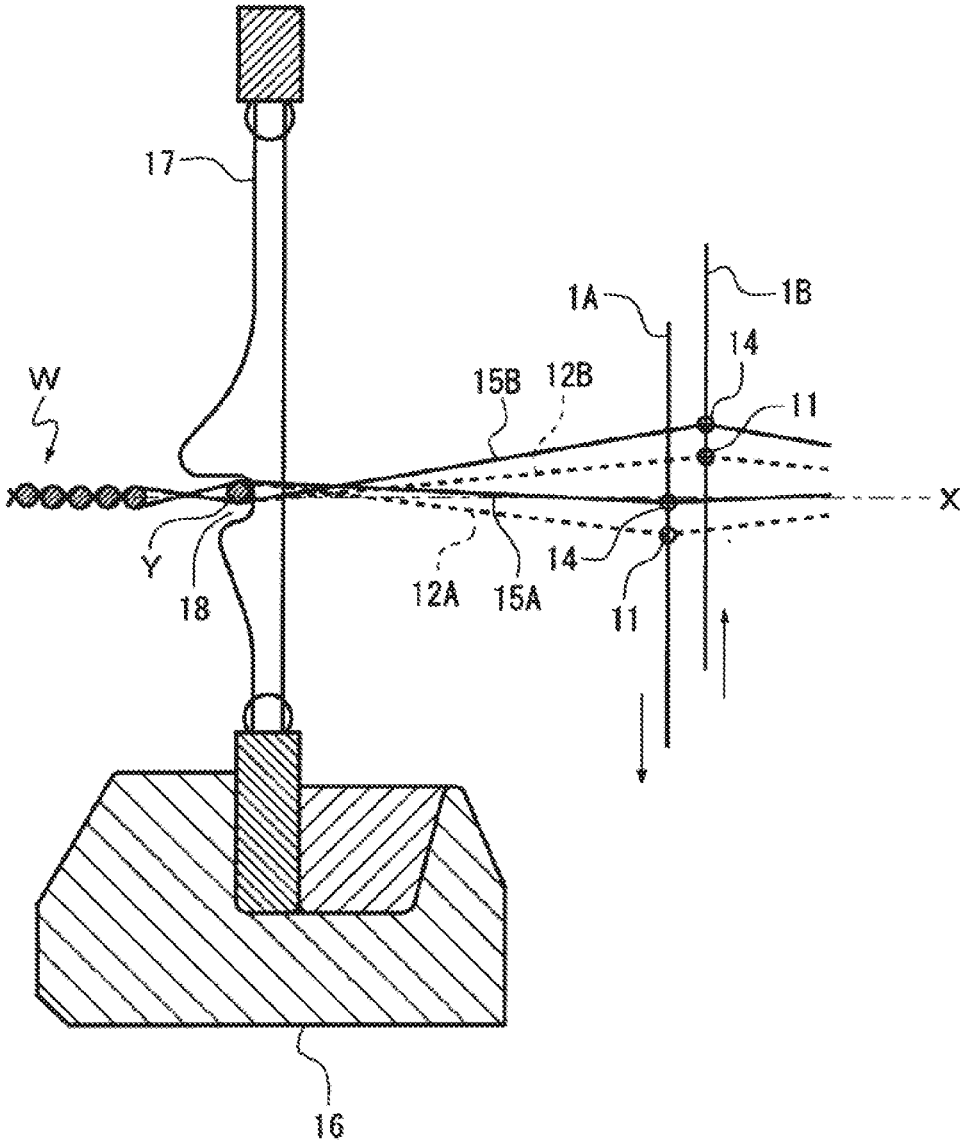
FIG. 4 is a partially sectional enlarged view showing a shed in an open state at a time of beating of a reed.

The following will describe the shedding operation of the ground warp yarns 12A and 12B arranged in the segment FC in the central portion of the heald frame in the weaving width direction and the ground warp yarns 15A and 153 arranged in the segments FEs at positions adjacent to the opposite ends of the heald frame in the weaving width direction with reference to FIGS. 3 to 5. FIG. 3 shows a heald frame 1A holding the ground warp yarns 12A and 15A that are passed through the thread eyelets 11 and 14 of the healds 8 and 9, respectively, and a heald frame 1B holding the ground warp yarns 12B and 15B that are passed through the thread eyelets 11 and 14 of the healds 8 and 9, respectively.

A reed 17 is fixedly mounted to a slay 16 and swingable between the heald frame 1A and the woven fabric W. The reed 17 includes a plurality of reed wires each having a recessed portion and is caused to swing in conjunction with rocking movement of the slay 16 by a drive mechanism (not shown). The recessed portions of the reed wires cooperate to form a guide passage 18 through which a weft yarn Y is inserted. Before a weft yarn Y is inserted, the warp shedding apparatus (not shown) forms a shed by moving the heald frame 1A upward and the heald frame 1B downward. FIG. 3 shows an open shed with the ground warp yarns 12A and 15A raised and the ground warp yarns 12B and 15B lowered, respectively.

Referring to FIG. 3 showing a state of the shed that is opened to its maximum, the shed opening amounts of the raised ground warp yarn 12A and the lowered ground warp yarn 12B in the segment FC are substantially the same, Specifically, the raised ground warp yarn 12A and the lowered ground warp yarn 12B are opened at substantially the same angle relative to the line X. Meanwhile, the shed opening amounts of the raised ground warp yarn 15A and the lowered ground warp yarn 15B that are in the segments FEs are different from each other. Specifically, the raised ground warp yarn 15A and the lowered ground warp yarn 15B are opened at different angles relative to the line X.

Since the thread eyelet 14 is formed at a position that is higher than the thread eyelet 11 as described above, when the shed is opened at its maximum, the raised ground warp yarn 15A is located higher than the raised ground warp yarn 12A and the angle of the raised ground warp yarn 15A relative to the line X is greater than that of the raised ground warp yarn 12A relative to the line X. The angle of the lowered ground warp yarn 15B relative to the line X is smaller than that of the lowered ground warp yarn 12B relative to the line X.

According to the present embodiment, however, while there occurs substantially no difference in the tension between the raised ground warp yarn 12A and the lowered ground warp yarn 12B in the segment FC, there exists a difference in the tension between the raised ground warp yarn 15A and the lowered ground warp yarn 15B that are in the segments FEs.

A weft yarn Y is inserted at the timing when the reed 17 is swung to the position at which the guide passage 18 is located in an open shed formed by the raised ground warp yarns 12A and 15A and the lowered ground warp yarns 12B and 15B, and the inserted weft yarn Y flies through the guide passage 18, as shown in FIG. 3. When the weft insertion is completed, the heald frames 1A and 1B are moved in the directions opposite to the arrows shown in FIG. 3 so as to close the shed of the raised ground warp yarns 12A and 15A and the lowered ground warp yarns 12B and 15B. At this time, the reed 17 is swung to the woven fabric W to beat the inserted weft yarn Y.

Referring to FIG. 4 showing the reed 17 beating the inserted weft yarn Y, the ground warp yarns 12A and 15A are being lowered and the ground warp yarns 12B and 15B are being raised thereby to form a new shed with the downward movement of the heald frame 1A and the upward movement of the heald frame 1B, as indicated by the arrows in the figure. Since the shed opening amounts of the ground warp yarns 12A and 12B are the substantially same, the angles of the ground warp yarns 12A and 12B relative to the line X are also the same, so that the portion of the inserted weft yarn Y that corresponds to the segment FC is held and tensioned by the ground warp yarns 12A and 12B with a uniform force.

Meanwhile, there is a difference in the shed opening amount between the ground warp yarns 15A and 15B that are passed through the thread eyelet 14 located higher than the thread eyelet 11. Specifically, the shed opening amount of the ground warp yarn 15B moving upward is greater than that of the ground warp yarn 12B moving upward, and the shed opening amount of the ground warp yarn 15A moving downward is smaller than that of the ground warp yarn 12A moving downward. This difference creates a difference in the tension between the ground warp yarns 15A and 15B.

As shown in FIG. 4, the tension applied to the ground warp yarn 15B is greater than the tension applied to the ground warp yarn 15A, and the ground warp yarn 15B pulls portions of the inserted weft yarn Y in the segments FEs upward before the weft yarn Y is beaten by the reed 17. Thus, the weft yarn Y is beaten by the reed 17 while being pulled upward by the ground warp yarn 15B. The opposite end portions of the inserted weft yarn Y are beaten by the reed 17 while being pulled upward by the ground warp yarns 15B or 15A.

Figure 5A:
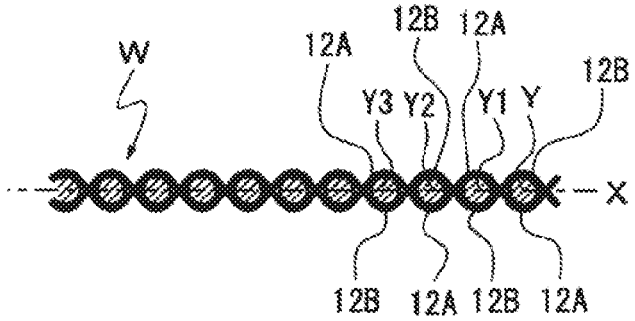
FIG. 5A is a cross-sectional view showing a state of ground warp yarns in the central portion of a woven fabric in the weaving width direction thereof.

The structure of the fabric W that is woven with the shedding motion explained with reference to FIGS. 3 and 4 will now be described with reference to FIG. 5. In the central segment FC of the heald frame 1 in which there is no difference in the tension between the ground warp yarns 12A and 12B, inserted weft yarns Y, Y1, Y2, Y3, and so forth (only four weft yarns are shown in the figure) are contacted and gripped by the ground warp yarns 12A and 12B with a uniform force. Therefore, the weft yarns Y, Y1, Y2, Y3, and so forth forming the woven fabric W are aligned along the line X, as shown in FIG. 5A, Meanwhile, in the side segments FEs in the opposite end portions of the heald frame 1, the shed opening amount of the ground warp yarns moved upward is greater than the shed opening amount of the ground warp yarns moved downward and the tension of the raised ground warp yarns is greater accordingly. Therefore, end portions of the inserted weft yarns Y, Y1, Y2, Y3, and so forth are beaten by the reed 17 while being pulled upward as shown in FIG. 5B.

Figure 5B:
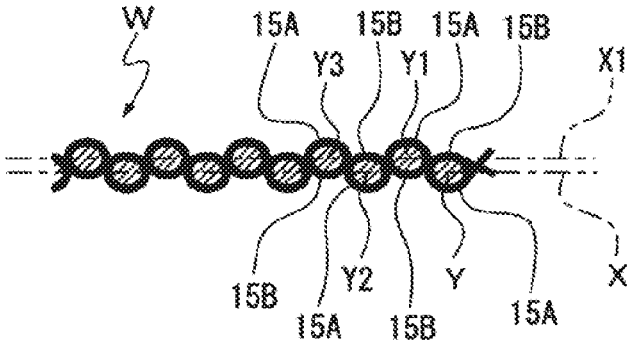
FIG. 5B is a cross-sectional view showing a state of ground warp yarns in the opposite end portions of a woven fabric in the weaving width direction.

FIG. 5B shows inserted weft yarns Y, Y1, Y2, Y3, and so forth in one of the segment FEs. Of the four weft yarns Y through Y3 shown in the figure, the weft yarn Y is the last beaten weft yarn and the weft yarn Y3 is the earliest beaten weft yarn. The weft yarn Y3 is beaten while being pulled upward by the ground warp yarn 15A that is then moving upward. The weft yarn Y3 thus beaten is located on an imaginary line X1 extending parallel to and above the line X that corresponds to the closed shed.

The weft yarn Y2 that is inserted next to the weft yarn Y3 is beaten while being pulled upward by the ground warp yarn 15B that is moving upward. However, the weft yarn Y3 that is present on the line X1 inhibits the further upward movement of the weft yarn Y2 and therefore, the weft yarn Y2 stays on the line X. The weft yarn Y1 inserted next to the weft yarn Y2 is beaten while being pulled upward by the ground warp yarn 15A moving upward. In the case of the weft yarn Y1, since the weft yarn Y2 on the line X does not inhibit the upward movement of the weft yarn Y1, the weft yarn Y1 is pulled upward and beaten onto the line X1.

The weft yarn Y is beaten while being pulled upward by the ground warp yarn 15B moving upward. However, the weft yarn Y1 that is beaten previous to the weft yarn Y is present on the line X1 and inhibits the further upward movement of the weft yarn Y and, therefore, the weft yarn Y is beaten onto the line X. Specifically, the weft yarns Y3 and Y1 receive a force that acts in the direction in which the woven fabric W is wound, in addition to the upward tension, so that the weft yarns Y3 and Y1 are beaten while being pulled obliquely upward. Meanwhile, the weft yarns Y2 and Y are inhibited from being moved upward by the weft yarns Y3 and Y1 and, therefore, beaten onto the line X beneath the line X1.

In the portions of the woven fabric W corresponding to the segments FEs of the heald frame adjacent to the opposite ends thereof, the weft yarns Y3, Y2, Y1 and Y are beaten alternately on the line X1 and the line X so that any two adjacent weft yarns are staggered from each other in the vertical direction, that is, the weft yarns Y3, Y2, Y1, and Y overlap one another in the fabric winding direction. Therefore, the portions of the woven fabric W adjacent to the opposite ends thereof corresponding to the segments FEs have a weave structure that is different from that of the central portion of the woven fabric W corresponding to the segment FC.

In the portions of the woven fabric W corresponding to the segments FEs of the heald frame, the contact area of the ground warp yarns 15A and 15B with the weft yarns Y3, Y2, Y1, and Y is increased as compared with the contact area of the ground warp yarns 15A and 15B with the weft yarns Y3, Y2, Y1, and Y in the portion of the woven fabric W corresponding to the segment FC, and the gripping force of the ground warp yarns 15A and 15B on the weft yarns Y3, Y2, Y1, and Y is increased accordingly. Such increased gripping force of the ground warp yarns 15A and 15B is capable of withstanding the shrinkage of the weft yarns Y3, Y2, Y1, and Y and, therefore, the weft yarns are prevented from being slackened or forming defective selvedges in the opposite end portions of the woven fabric W.

According to the first embodiment of the present invention, the difference in the tension between the ground warp yarns 15A and 15B in the opposite end portions of the woven fabric W in the weaving width direction thereof is greater than the difference in the tension between the ground warp yarns 12A and 12B in the central portion of the woven fabric W in the same direction, so that the weft yarns Y3, Y2, Y1, and Y are beaten while the opposite ends of the weft yarns Y3, Y2, Y1, and Y are being pulled by either the ground warp yarn 15A or the ground warp yarn 15B, whichever the tension is greater.

The weft yarns Y3, Y2, Y1 and Y that are inserted and beaten in this order partially overlap in the vertical direction with one another at the opposite ends thereof, so that the contact area between the weft yarns Y3, Y2, Y1 and Y and the ground warp yarns 15A and 15B is increased in the opposite end portions of the woven fabric W, resulting in an increased force of the ground warp yarns to grip the weft yarns. Thus using some of the ground warp yarns forming the woven fabric W prevents warp yarns from being slackened and forming defective selvages in the opposite end portions of the woven fabric W with such a simple structure and without using additional warp yarns.

Furthermore, according to the first embodiment, the healds 9 that hold the ground warp yarns 15A and 15B in the opposite end portions of heald frames are formed so as to have the thread eyelet 14 at a position higher than the position of the thread eyelet 11 of the healds 8 that hold the ground warp yarns 12A and 12B in the central portion of the heald frame 1. This simple structure permits a difference in the shed opening amount between the ground warp yarns 15A and 15B, which makes the difference in the tension between the ground warp yarns 15A and 15B greater than that between the ground warp yarns 12A and 12B, so that the weft yarns are prevented from being slackened in the opposite end portions of the woven fabric, Furthermore, the shed opening amount of the ground warp yarn 15A or the ground warp yarn 15B in the segments FEs in the opposite end portions of the heald frames is greater than that of the ground warp yarn 12A or the ground warp yarn 12B in the central segment FC of the heald frames, with the result that the inserted weft yarns Y are pulled upward or downward at the opposite ends thereof with a larger tension to thereby further prevent the weft yarns Y from being slackened and forming a defective selvedge.

Second Embodiment

Figure 6:
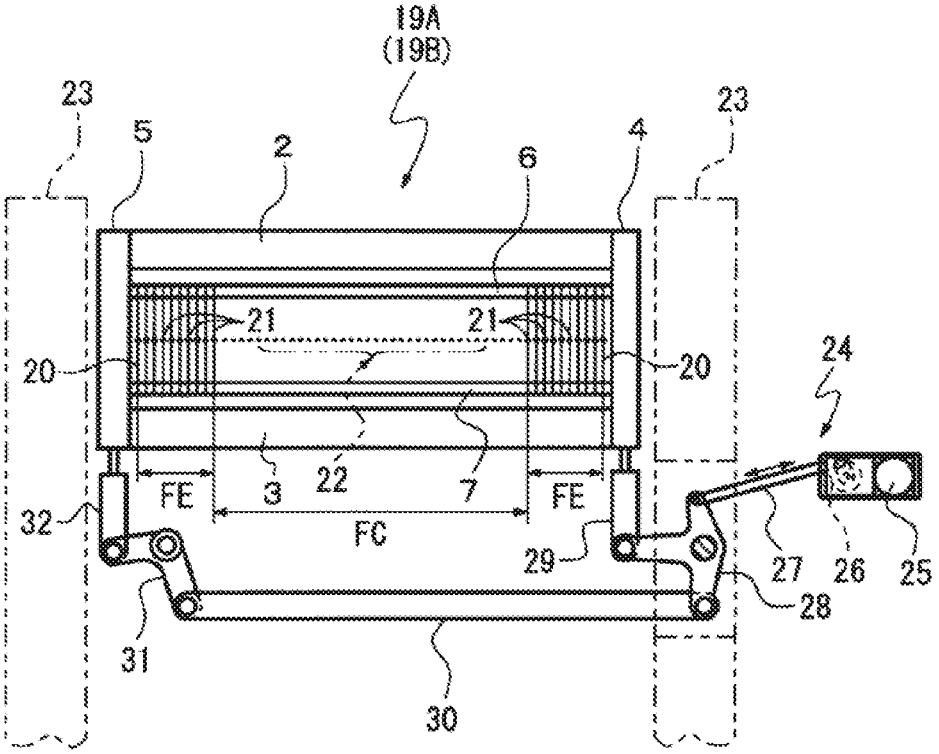
FIG. 6 is a front view of a wrap shedding apparatus according to a second embodiment of the present invention.

A second embodiment of the present invention will now be described with reference to FIG. 6. The like reference numerals used in the following description designate the like components in the first embodiment and detailed descriptions on such components will be simplified or omitted. A warp shedding apparatus of a loom according to the second embodiment of the present invention includes a heald frame 19A and a heald frame 19B that is disposed rearward of the heald frame 19A (only the heald frame 19A is shown in FIG. 6). It is so configured that the heald frames 19A and 19B hold only the ground warp yarns 15A and 15B (see FIG. 3) in the side segments FEs, while the ground warp yarns 12A and 12B (see FIG. 3) for the central segment FC are held by the other heald frames (not shown).

The heald frames 19A and 19B have only healds 20 that are disposed in the segments FEs in the opposite end portions of the respective heald frames 19A and 19B in the weaving width direction of the loom and fixed at the opposite ends thereof to the upper and lower carrier rods 6 and 7. Each heald 20 has a thread eyelet 21 at the center thereof in the vertical direction in the same manner as thread eyelets 22 (see the imaginary line in FIG. 6) of the healds (not shown) that hold the ground warp yarns 12A and 12B in the segment FC in the central portion of the heald frame.

The vertical motion of the heald frames 19A and 19B is guided by brackets (not shown) mounted to a pair of frames 23 provided on the opposite lateral sides of the loom. Each of the heald frames 19A and 19B is connected to its associated drive mechanism 24 that is provided outside of the frames 23. Each drive mechanism 24 includes a drive motor 25 and an eccentric cam 26 that is driven to rotate by the drive motor 25. The eccentric cam 26 is connected via a connecting rod 27 to a rocking lever 28 having three arms and rotatably mounted in the frame 23.

Rotation of the eccentric cam 26 is transmitted to the rocking lever 28 through the connecting rod 27 to thereby cause the rocking lever 28 to swing. The rocking lever 28 is connected at one arm thereof to a rod 29 that is connected to the bottom end of the side frame 4 of each of the heald frames 19A and 19B. The rocking lever 28 is also connected at another arm thereof to a rod 32 that is connected to the bottom end of the side frame 5 of each of the heald frames 19A and 19B via a connecting lever 30 and a rocking lever 31 having two arms. With this configuration, the rotation of the drive motors 25 causes the heald frames 19A and 19B to reciprocally move in the vertical direction for shedding motion.

It is to be noted that the configuration of the drive mechanism 24 that is shown in FIG. 6 and includes the drive motor 25, the eccentric cam 26, the connecting rod 27, and the rocking lever 28 is specific to the drive mechanisms 24 for the heald frames 19A and 19B only, and similar drive mechanisms are provided for the other heald frames of the loom. Such other drive mechanisms are associated with their corresponding heald frames other than the heald frames 19A and 19B. Thus, the heald frames are driven independently from each other for shedding motion.

The drive motor 25 is controlled by a control device (not shown) that stores therein a program to control the rotation of the drive motor 25 so that the shedding speed and the dwell angle of the shed are set or modified appropriately. According to the second embodiment, the drive motor 25 causes the ground warp yarns 15A and 15B in the segments FEs to make shedding motion with a desired dwell angle that is previously set in the program of the control device.

By allowing the ground warp yarns 15A and 15B in the segments FEs to form a shed with a specified dwell angle, a difference is created in the tension between the ground warp yarn 15A that is moved upward and the ground warp yarn 15B that is moved downward, and the force of the ground warp yarns 15A and 15B to grip the inserted weft yarns Y, Y1, Y2, Y3, and so forth (see FIG. 5) is increased. Therefore, it is possible to prevent the ground warp yarns from being slackened and forming defective selvedges in the opposite end portions of a woven fabric W in the weaving width direction with the simple structure.

According to the second embodiment in which each of the heald frames 19A and 19B holding the ground warp yarns 15A and 15B in the opposite end portions thereof are driven independently by the drive motor 25 of the associated drive mechanism 24, the shedding speed and the dwell angle of the shed of the respective heald frames 19A and 19B may be designed appropriately so as to create a desired difference in the tension between the ground warp yarns 15A and 15B. Therefore, the warp shedding apparatus according to the second embodiment prevents the weft yarns from being slackened and forming defective selvedges with the simple structure, as in the case of the first embodiment.

It is to be noted that the present invention is not limited to the above embodiments and may variously be modified within the scope of the present invention as exemplified below:

(1) Although according to the first embodiment of the present invention, the difference in the tension is substantially zero between the ground warp yarns 12A and 12B in the segment FC in the central portion of the heald frames. However, a difference of a specified magnitude may be provided in the tension between the warp yarns 12A and 12B. In such a case, the difference may be set such that the difference in the tension between the ground warp yarns 15A and 15B in the segments FEs is greater than the difference in the tension between the ground warps 12A and 12B.

(2) In the first embodiment, the thread eyelet 14 of the heald 9 may be provided at a position that is lower than the thread eyelet 11 of the heald 8 by the distance H.

(3) In the first and second embodiments, the number of the ground warp yarns 15A and 15B in the segments FEs in the opposite end portions of the heald frame may be several or several tens, or even more than that.

(4) In the first and second embodiments, the support portions 10 and 13 of the healds 8 and 9 are formed by holes. However, the support portions 10 and 13 may be provided by a hook such as the one used in the healds of the riderless heald frames.

(5) In the first and second embodiments, shedding motion is achieved by mounting the healds 8 and 9 to the heald frames 1, 1A, 1B, 19A, and 19B. However, the healds 8 and 9 may be moved directly to form a shed using a jacquard weaving device.

(6) The shedding apparatus according to the first and second embodiments of the present invention may be used in a loom including, but not limited to, a water jet loom, an air jet loom, and a rapier loom.

What is claimed is:

1. A warp shedding apparatus of a loom comprising:

a plurality of healds arranged in a weaving width direction of the loom, each heald having a thread eyelet through which a ground warp yarn is passed and held, wherein the healds are raised and lowered alternately to form a shed, and a difference in tension between raised ground warp yarns and lowered ground warp yarns held by the healds that are located in opposite end portions in the weaving width direction is greater than a difference in tension between raised ground warp yarns and lowered ground warp yarns held by the healds that are located in a central portion in the weaving width direction.

2. The warp yarn shedding apparatus of the loom according to claim 1, wherein one of a shed opening amount of the raised ground warp yarns held by the healds located in the opposite end portions in the weaving width direction and a shed opening amount of the lowered ground warp yarns held by the healds located in the opposite end portions in the weaving width direction is greater than the other.

3. The warp yarn shedding apparatus of the loom according to claim 2, wherein one of a shed opening amount of the raised ground warp yarns held by the healds located in the opposite end portions in the weaving width direction and a shed opening amount of the lowered ground warp yarns held by the healds located in the opposite end portions in the weaving width direction is greater than shed opening amounts of the raised ground warp yarns and the lowered ground warp yarns held by the healds located in the central portion in the weaving width direction.

4. The warp shedding apparatus of the loom according to claim 1, wherein the thread eyelets of the healds in the opposite end portions in the weaving width direction are located higher or lower than the thread eyelets of the healds located in the central portion in the weaving width direction.

5. The warp shedding apparatus of the loom according to claim 1, wherein the warp shedding apparatus comprises a plurality of heald frames to which the healds are mounted, a plurality of drive mechanisms each including a drive motor connected to corresponding one of the heald frames, each drive mechanism is configured such that the drive motor drives the heald frame independently from the other heald frames to form a shed, and at least one of the heald frames holds by the healds the ground warp yarns only in the opposite end portions in the weaving width direction.

* * * * *